US005931634A

United States Patent [19]

Neri

[11] Patent Number: 5,931,634

[45] Date of Patent: Aug. 3, 1999

[54] DEVICE AND A METHOD FOR THE FORMATION OF SHEETS OR GROUPS OF SHEETS, PARTICULARLY BANKNOTES, INTO ORDERED STACKS

[75] Inventor: Armando Neri, Bologna, Italy

[73] Assignee: G.D S.p.A., Bologna, Italy

[21] Appl. No.: 09/093,918

[22] Filed: Jun. 9, 1998

[30] Foreign Application Priority Data

Jun. 9, 1997 [IT] Italy ..... B097A0348

[51] Int. Cl.[6] ..... B65G 57/02

[52] U.S. Cl. ..... 414/790; 271/217

[58] Field of Search ..... 414/790, 790.1, 414/790.2, 802; 271/217, 218

[56] References Cited

U.S. PATENT DOCUMENTS

| | | | |
|---|---|---|---|
| 3,392,852 | 7/1968 | Tegner | 414/790 |
| 3,982,642 | 9/1976 | Muller . | |
| 4,498,381 | 2/1985 | Convey, Jr. | 100/100 |
| 4,538,511 | 9/1985 | Wise | 414/790.2 X |
| 4,541,763 | 9/1985 | Chandhoke et al. | 414/790.2 X |
| 4,953,845 | 9/1990 | Castiglioni | 414/907 X |
| 4,977,827 | 12/1990 | Chandhoke et al. | 414/790 X |
| 5,215,428 | 6/1993 | Masini | 414/790 X |
| 5,312,223 | 5/1994 | Kleinhen | 414/788.3 |
| 5,460,479 | 10/1995 | Neumann | 414/789.5 |

FOREIGN PATENT DOCUMENTS 0 365 870 5/1990 European Pat. Off. .

*Primary Examiner*—Janice L. Krizek
*Attorney, Agent, or Firm*—Pillsbury Madison & Sutro LLP

[57] ABSTRACT

In a machine equipped with a plurality of stacking stations for the assembly of single banknotes or bundles of banknotes into ordered stacks, notes checked and passed as good by an upline station are accumulated on a companion element associated with each station and capable of movement between a first receiving position, at which the banknotes or bundles are assembled into a stack, and a second position at which the stack is released onto a fixed support. The support is slotted in such a way that the companion element can be dropped further and removed sideways without touching either the stack or the support itself, and the movement of the companion element between the receiving and release positions occurs cyclically, describing a looped trajectory.

25 Claims, 3 Drawing Sheets

100
1
7a
7
8
1
9
7
8
7
9
6
6a
8
6
35
7
1
8
9
6
5
6a
5a
12
10
11b
11
5a
5
35
15
36
6
17
11b
3
5a
11
35
39
47
45
40
F4
11'
F3
F2
7b
11b
12
14
47
40
45
39
5a
11'
36
37
5
9

F1
F5
F3

DEVICE AND A METHOD FOR THE FORMATION OF SHEETS OR GROUPS OF SHEETS, PARTICULARLY BANKNOTES, INTO ORDERED STACKS

BACKGROUND OF THE INVENTION

The present invention relates to a device for the formation of sheets or groups of sheets, typically banknotes, into ordered stacks.

The present invention is employable to advantage in machines by which banknotes are ordered and wrapped in bundles, or groups of bundles, and indeed direct reference is made in the following specification to this same art field albeit with no limitation in general scope implied.

The prior art embraces machines designed to verify the quality and integrity of banknotes, consisting typically in a plurality of stacking modules or stations each equipped with a respective channel along which the stacks are formed. Each one of the single modules or stations is filled at its infeed end with a succession of single notes, which may be of any given type, whereupon these are examined, for example by optical means, and any defective items discarded; the good notes are then divided up according to denomination and/or type and directed toward respective independent outlets afforded by the stacking stations of the machine.

In this way, groups or stacks of single banknotes are formed at each of the outlets. Once a selected number of banknotes per group has accumulated, the resulting stack will be picked up and transferred to a bundling machine by which it is bound with at least one wrapping band.

Alternatively, the machines in question can be supplied at the infeed end of each stacking station with a succession of bundles, that is to say sheets already checked and bound with respective wrapping bands, in such a way that the banknotes collecting at the outlets of the single stations consist not in stacks of discrete notes, but rather in stacks of bundled notes that are then picked up manually and transferred elsewhere.

The object of the present invention is to set forth a device such as will improve the process whereby sheets, in particular banknotes emerging from a checking machine, are formed into ordered stacks; in particular, increasing the productivity of the process and refining the manner in which the stacks are picked up and transferred.

A further object of the present invention is to provide a method whereby stacks of single sheets and stacks of previously bundled sheets can be assembled and transferred automatically and with equal ease.

SUMMARY OF THE INVENTION

The stated objects are comprehensively realized in a device according to the present invention for the formation of sheets or groups of sheets into ordered stacks, in particular banknotes emerging from respective checking stations of a machine for the assembly of banknotes or bundles of banknotes into ordered stacks. The essential feature of such a device, which consists in a plurality of stacking stations equipped with respective feed ducts and stacking channels, is that it comprises a companion element, associated with each one of the stacking stations, by which the sheets are taken up one on top of another; the companion element is capable of movement between a first receiving position in which the sheets are allowed to accumulate and form into a stack, and a second release position in which the stack is deposited on support means operating in conjunction with the companion element.

The invention relates also to a method for the formation of sheets or groups of sheets, typically banknotes or bundles of banknotes, into ordered stacks.

More exactly, the present invention relates to a method of forming sheets or groups of sheets into ordered stacks, in particular banknotes emerging from respective checking stations of a machine for the assembly of banknotes or bundles of banknotes into ordered stacks, consisting in a plurality of stacking stations equipped with respective feed ducts and stacking channels; the method disclosed comprises the steps of accumulating the sheets on a respective companion element when stationed at a first receiving position in such a way as to form a stack; then moving the companion element between the first receiving position and a second release position in which the stack is deposited on support means operating in conjunction with the companion element.

Employing the device and the method according to the present invention, single or bundled sheets, in particular banknotes, can be assembled into stacks and removed automatically for transfer elsewhere, thereby minimizing the unproductive time between the removal of one stack and the commencement of the next.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
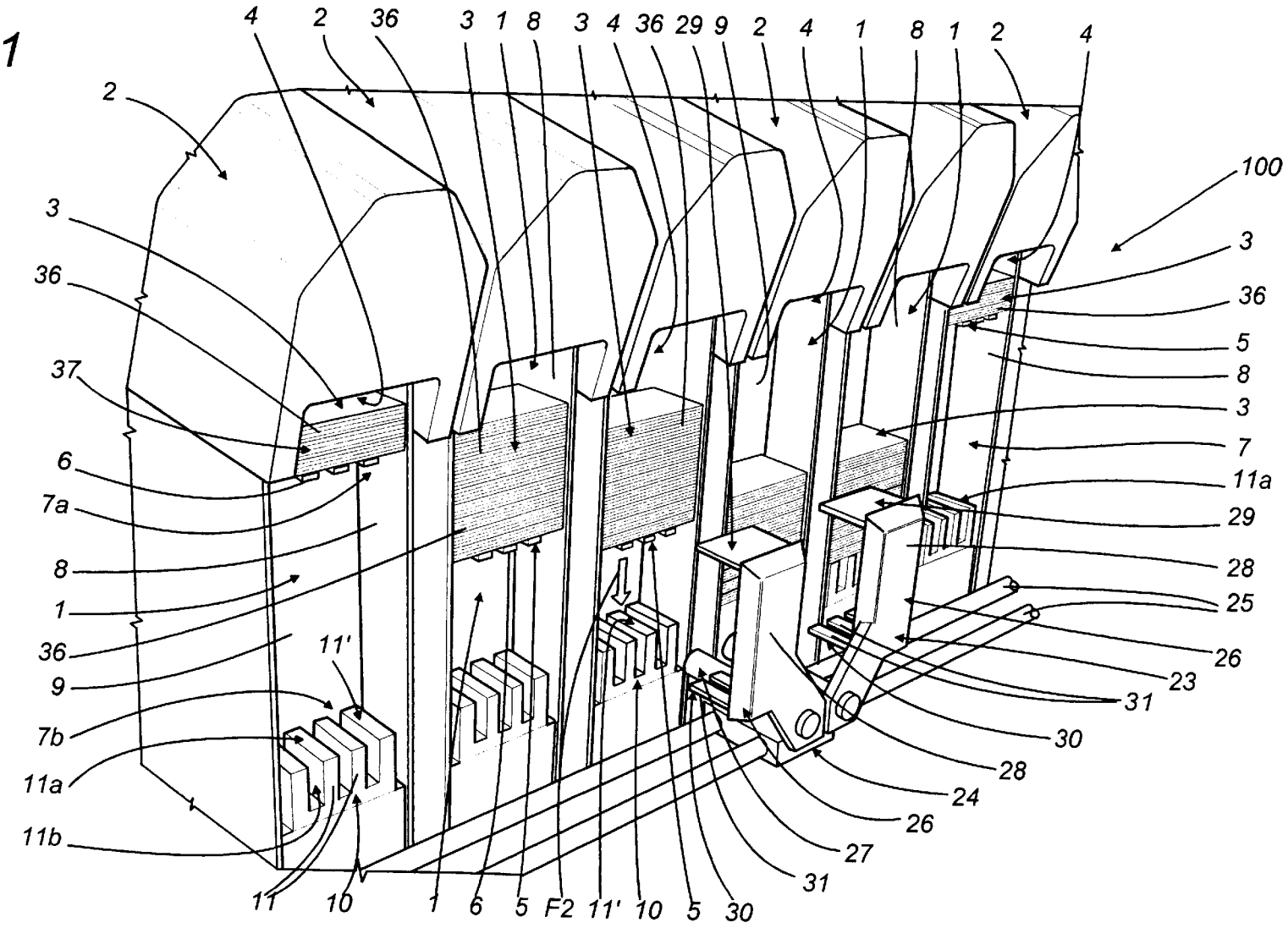
FIG. 1 illustrates a machine for the assembly of single or bundled banknotes into ordered stacks, viewed schematically in perspective from the front with certain parts omitted for clarity, which is equipped with a plurality of stacking stations and, associated with each station, a device embodied in accordance with the present invention.
Figure 2:
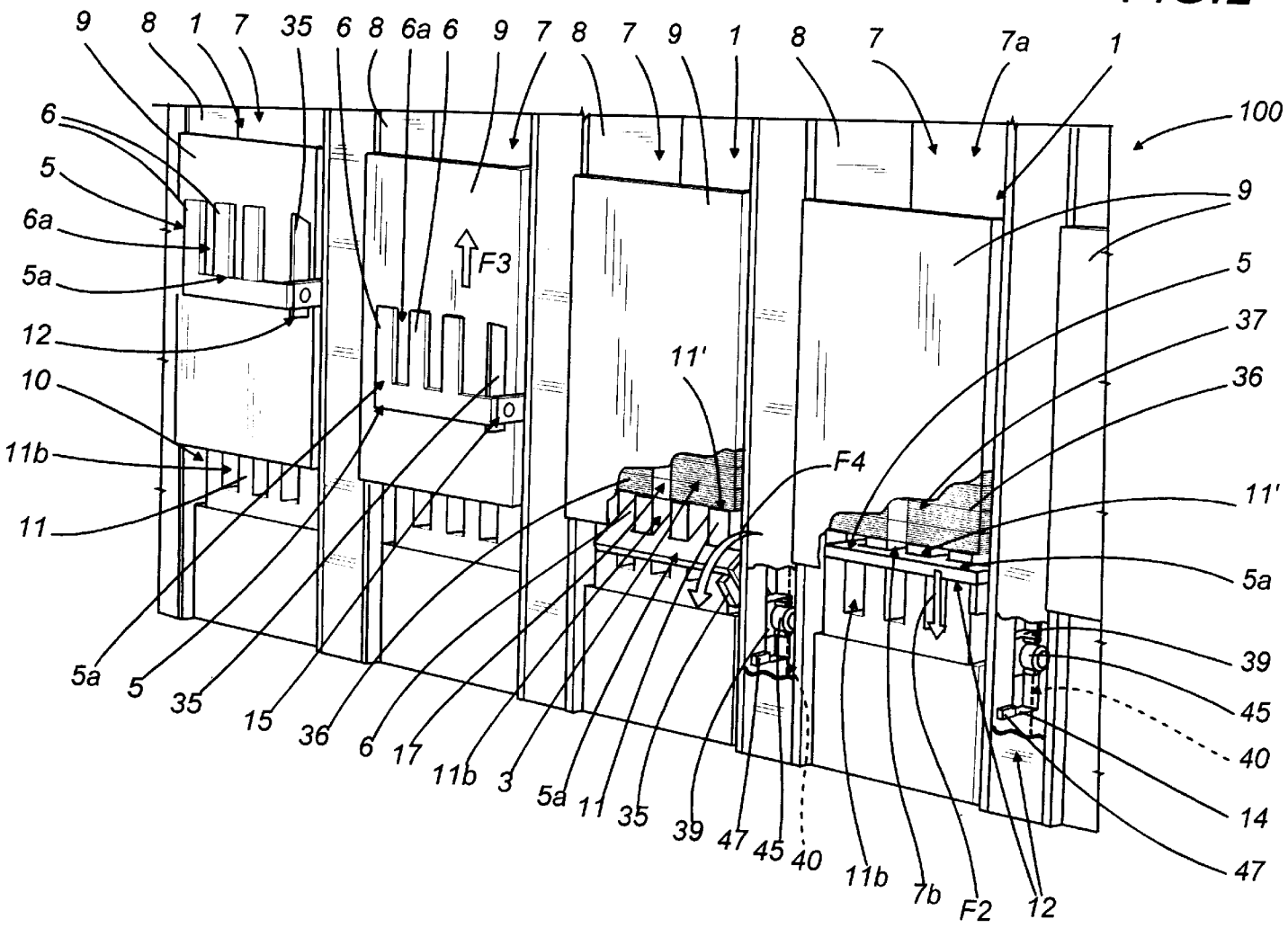
FIG. 2 shows the machine of FIG. 1 schematically and in perspective from the rear, with certain parts omitted for clarity.

With reference to FIGS. 1 and 2 of the drawings, 100 denotes a machine, in its entirety, by which banknotes or bundles of banknotes are assembled into ordered stacks; such a machine comprises a plurality of stacking stations 1 disposed alongside one another, of which the function is to turn out ordered stacks 3 either of single banknotes 36 or of bundles 37 of banknotes bound with respective wrapping bands 17. Each station 1 comprises a feed duct 4 along which banknotes 36 are conveyed, after verification and selection, either singly or bound by at least one wrapping band to form a bundle 37. Associated with each of the stacking stations 1 is a device, denoted 12 in its entirety, by which the banknotes or bundles of banknotes are formed into ordered stacks.

The banknotes 36 emerge singly or in bundles 37 from a respective checking station 2 illustrated only in part and schematically in FIG. 1, being of conventional embodiment.

Figures 3, 4:
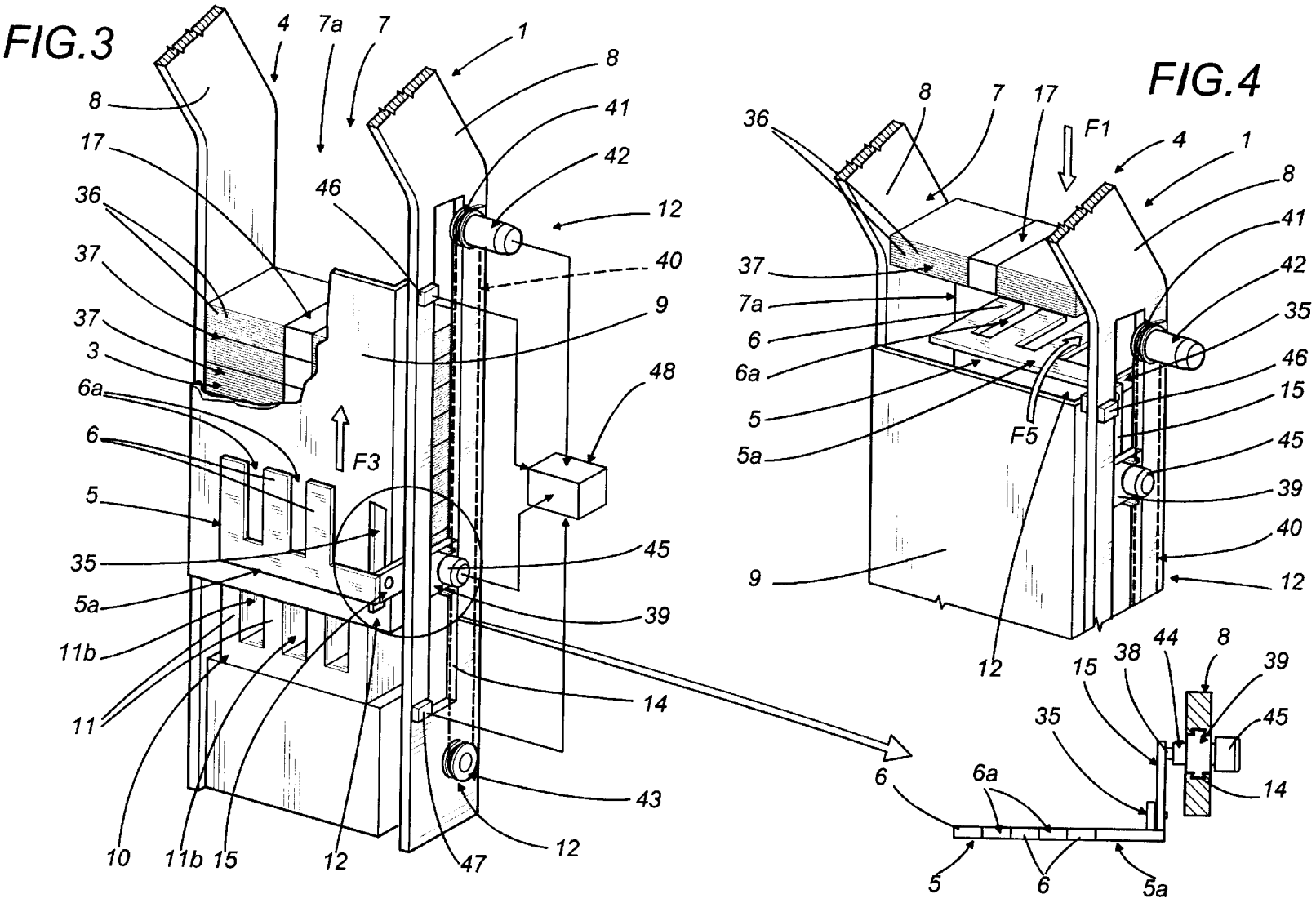
FIG. 3 illustrates a stacking station equipped with the device according to the present invention, seen schematically and in perspective with certain parts omitted for clarity, and shown in a first operating configuration.
FIG. 4 illustrates a detail of the device of FIG. 3, shown in a further operating configuration.

It will be observed that, whereas FIGS. 2, 3 and 4 of the drawings indicate bundles 37 of banknotes 36 only, and stacks 3 of single banknotes 36 are shown only in FIG. 1, the application of the invention to single sheets is obvious and requires no further explanation or detailed illustration.

As illustrated in FIGS. 2, 3 and 4, the device 12 comprises a companion element 5 with fingers 6 affording a first bearing surface 5*a* onto which the banknotes 36 or bundles 37 of notes emerging from the feed duct 4 are caused to drop by gravity in the direction denoted F1 (FIG. 4) and come to rest.

The companion element 5 is capable of movement along a channel 7 having a substantially vertical axis. The channel 7 in its turn is open fronted, and equipped with side walls 8 and a rear wall 9 between which the single banknotes 36 or bundles 37 are retained. More exactly, the companion element 5 is capable of movement between a first receiving position, coinciding with the upper part 7*a* of the channel 7, in which the single banknotes 36 or bundles 37 of notes emerging from the feed duct 4 are deposited in succession one on top of another on the fingers 6 of the companion element 5 until an ordered stack 3 is formed, and a second release position coinciding with the lower part 7*b* of the channel 7, in which the accumulated stack 3 is transferred from the companion element 5 to a fixed support element 10 forming part of the device 12.

The support element 10 exhibits a plurality of projections 11 directed toward the upper part 7*a* of the channel 7; as discernible from the drawings, the projections 11 are effectively directed upward from the support element 10 in such a manner that the free topmost edges 11', which afford a second bearing surface 11*a* for a completed stack 3, are separated one from the next by respective gaps 11*b* and insertable thus into corresponding gaps 6*a* by which the fingers 6 of the companion element 5 are separated one from another. Thus, in operation, as the companion element 5 descends below the level of the second bearing surface 11*a* (FIG. 1) afforded by the support element 10, the stack 3 of banknotes 36 or bundles 37 of banknotes will be brought to rest on the support element 10 when the fingers 6 of the companion element 5 locate in the gaps 11*b* afforded by the projections 11 of the support element 10.

As discernible from FIGS. 1, 2 and 4, whenever the companion element 5 occupies the receiving position or is moving along the channel 7 in the direction denoted F2 (FIG. 1) that takes it from the receiving position toward the release position, the fingers 6 will be disposed substantially horizontal in such a way as to accommodate and support the accumulated stack 3 of banknotes 36 or bundles 37 of notes.

During the movement of the companion element 5 from the release position to the receiving position, on the other hand, in the direction denoted F3 (FIGS. 2 and 3), the fingers 6 are disposed substantially parallel to the axis of the channel 7 and therefore substantially vertical, minimizing the dimensions of the element in a substantially horizontal plane and occupying a position externally of the rear wall 9 of the channel 7 in such a way as to avoid interference with the stack 3 when resting on the surface 11*a* afforded by the top edges 11' of the projections 11.

Having deposited the stack 3 on the top edges 11' of the projections 11, as illustrated in FIG. 2, the companion element 5 is made to follow a trajectory resulting from a combination of two distinct but synchronously generated components, one of which being a further movement downwards in the direction denoted F2, whereby the fingers 6 are caused to advance a given distance further into the gaps 11*b* between the projections 11, and the other, a first rotation substantially through 90° toward the rear wall 9 of the channel 7 in the direction denoted F4 that takes the fingers to a position externally of the wall in readiness to make a return movement in the direction denoted F3, substantially parallel to the movement made previously during the formation of the stack 3. Thereafter, having regained the receiving position in the upper part 7*a* of the channel 7, the companion element 5 makes a second rotation through 90° in the opposite direction, denoted F5 (FIG. 4), and resumes a substantially horizontal position within the channel 7 and below the feed duct 4, passing beyond the top end of the rear wall 9 and positioning itself in readiness to receive more banknotes 36 or bundles 37.

To optimize the formation of the stack 3 of sheets, the companion element 5 is invested preferably, at least when starting from the receiving position, with a gradual descending motion depending on the number of banknotes 36 or bundles 37 accumulating on the fingers 6; the characteristics of this same descending motion will depend in practice on the number of banknotes 36 or bundles 37 emerging from the feed duct 4 per unit of time.

The machine 100 further comprises means 23 by which the stacks 3 of banknotes 36 or bundles 37 of notes deposited on the companion element 5 are collected and transferred.

Such collection means 23 incorporate a slide 24 translatable horizontally along ways 25 extending across the front of the stations 1 in which the stacks 3 of banknotes 36 or bundles 37 of notes are assembled. The slide 24 carries gripper means 26 translatable along further ways 27 in a direction normal to that of the slide 24 and serving to pick up the stacks 3 from the support elements 10. The gripper means 26 comprise a head 28 with which a top arm 29 and a bottom arm 30 are associated, the bottom arm affording fingers 31 insertable between the projections 11 of each support element 10 and beneath the stack 3 resting on the projections. Advantageously, at least one of the two gripper arms 29 and 30 can be made capable of movement in relation to the other arm 30 and 29 in such a way as will allow of compacting and applying a firm hold to the stack 3, and enabling the gripper 26 to adapt to stacks of different height.

In the example of FIGS. 3 and 4, which illustrates a generic embodiment of the device 12, the companion element 5 is secured rigidly to one end of an arm denoted 15, of which the opposite end is mounted rotatably by way of a pivot 38 to respective slide means 39.

The slide 39 is coupled with and translatable along a slot 14 afforded by one of the two side walls 8 compassing the stacking channel 7, which functions therefore as a track. More precisely, the slide 39 is caused to translate along the slot 14 through the agency of a flexible drive component 40 looped around a driving wheel 41 located at the top end of the channel, set in rotation by a first motor 42, and a driven wheel 43 located at the bottom end of the channel 7. The two wheels 41 and 43, driving and driven respectively, are supported rotatably by the same side wall 8 of the channel 7.

The pivot 38 that supports the end of the arm 15 opposite from the end rigidly associated with the companion element 5 is connected, preferably by way of a clutch 44, to the shaft of a second motor 45 mounted to the slide 39.

The device 12 further comprises a first sensor 46, located adjacent to the slot 14 on the relative side wall 8 and in alignment with the receiving position of the companion element 5, also a second sensor 47 located likewise adjacent to the slot 14 on the same side wall 8 and in alignment with the release position of the companion element 5. The first sensor 46 and second sensor 47 and the two motors 42 and 45 are connected to monitoring and control means 48 programmed to activate the two motors 42 and 45 cyclically when the companion element 5 is detected by the sensors 46 and 47 as being present at the receiving position and at the release position, respectively.

It will be evident from the foregoing description of the device 12 that the movement of the companion element 5 along and tangentially to the channel 7 is cyclical, and accompanies a periodic alternation between the positions at which the stacks 3 are received and released, respectively, during which the companion element 5 follows a path describing a predetermined closed loop. The path in question is not indicated pictorially in the drawings, being readily discernible from the various steps in the movement of the element 5 which are illustrated in each of the figures.

In operation, the accumulation of banknotes 36 or bundles 37 of notes into a stack 3 commences with the companion element 5 in the receiving position, occupying the upper part 7*a* of the channel 7, with the fingers 6 disposed substantially horizontal (FIG. 4). As the banknotes 36 or bundles 37 emerging from the feed duct 4 settle on the fingers 6, the slide 39 and the companion element 5 are caused by the flexible drive 40 to move downwards, in the direction denoted F2 (FIG. 1), continuing to the point at which the companion element 5 reaches the release position, occupying the lower part 7*b* of the channel 7, and the banknotes 36 or bundles 37 are deposited on the support element 10.

On receipt of a signal from the second sensor 47 indicating that the companion element 5 has gained the release position, the monitoring and control means 48 will pilot the motor 42 of the flexible drive 40 to advance the companion element 5 a short distance further in the direction denoted F2. At the same time, the second motor 45 and clutch 44 will be activated by the monitoring and control means 48 in such a way as to rotate the arm 15 in the direction denoted F4 (FIG. 2) and, after a given delay, the first motor 42 is deactivated.

The arm 15 is rotated by the second motor 45 to the point of bringing the fingers 6 of the companion element 5 into a position disposed substantially vertical and parallel with the rear wall 9 (FIGS. 2 and 3). Once the fingers 6 are in this position, the monitoring and control means 48 will cause the motor 45 to stop, deactivating the clutch 44, and restart the motor 42 of the flexible drive 40 in the opposite direction in such a way as to elevate the slide 39 together with the companion element 5, in the direction denoted F3, toward the receiving position.

On receipt of a signal from the first sensor 46 indicating the return of the companion element 5 to the receiving position, the monitoring and control means 48 will stop the motor 42 of the flexible drive 40 and activate the second motor 45 and the clutch 44 in such a way as to rotate the arm 15 in the direction denoted F5 (FIG. 4), thus bringing the fingers 6 into a substantially horizontal position ready to take up the banknotes 36 or bundles 37 of notes emerging from the feed duct 4.

Once the fingers 6 have regained the horizontal position, the monitoring and control means 48 will deactivate the second motor 45 and the clutch 44, and restart the motor 42 of the flexible drive 40 in such a way as to lower the companion element 5 toward the release position as it continues to take up the banknotes 36, singly or in bundles 37.

The cycle thus described continues to be repeated continuously or intermittently, according to the frequency with which the stacks 3 are removed by the collection and transfer means 23.

What is claimed:

1. A device for the formation of sheets or groups of sheets into ordered stacks, in particular banknotes emerging from respective checking stations of a machine by which banknotes are assembled singly or in bundles and formed into ordered stacks, the machine comprising a plurality of stacking stations equipped with respective feed ducts and stacking channels, the device comprising a companion element associated with each of the stacking stations in such a way as to take up the sheets one on top of another, wherein the companion element is capable of movement between a first receiving position in which the sheets are allowed to accumulate into a stack, and a second release position in which the stack is deposited on respective support means operating in conjunction with the companion element, wherein the companion element is associated with respective actuating means and caused by the selfsame actuating means to alternate cyclically between the first receiving position and the second release position following a predetermined path that consists in a closed loop, wherein the actuating means operate in conjunction with guide means of which the function is to control the translational movement of the companion element between the receiving and release positions, and wherein the guide means consist in a slide translatable along a slot fashioned in at least one of the side walls laterally encompassing the stacking channel.

2. A device as in claim 1, wherein the companion element is embodied with fingers separated one from another by gaps and affording a first bearing surface on which to position the sheets.

3. A device as in claim 1, wherein the support means comprise a plurality of projections distanced one from another by gaps, of which the free ends afford a second bearing surface offered to the sheets.

4. A device as in claim 3, wherein the fingers of the companion element are insertable into the gaps existing between the projections of the support means.

5. A device as in claim 3, wherein the stacks are removed from the channels by collection and transfer means comprising gripper means.

6. A device as in claim 5, wherein the gripper means are capable of movement horizontally in a direction substantially parallel to the support means and in a direction substantially perpendicular to the support means.

7. A device as in claim 6, wherein gripper means comprise a top gripping element, and a bottom gripping element embodied with fingers insertable into the gaps existing between the projections of the support means.

8. A device as in claim 7, wherein the distance separating the top gripping element from the bottom gripping element of the gripper means is adjustable.

9. A device as in claim 1, wherein the companion element is capable of movement cyclically from a first receiving position coinciding substantially with the upper part of the stacking channel, in which the sheets are taken up, to the second release position in which the stack is brought to rest on the support means, then back to the first receiving position, following a predetermined path that consists in a closed loop.

10. A device as in claim 1, wherein the guide means are associated with rotary actuating means by which the companion element, having released the stack onto the support means, is rotated and caused as a result to pass freely through the support means and exit from the lower part of the channel, then caused ultimately to re-enter the channel on reaching an upper part remote from the lower part and positioned in readiness to receive further sheets.

11. A device as in claim 1, wherein the actuating means comprise a flexible drive component associated in a closed loop with respective wheels of which one is a driving wheel.

12. A device as in claim 11, wherein the wheels comprise a first wheel positioned to coincide with the upper part of the channel and a second wheel positioned to coincide with the lower part of the channel.

13. A device as in claim 1, wherein the actuating means operate in conjunction with sensors of which the function is to detect the presence of the companion element at the receiving position and at the release position and thereupon supply corresponding signals to monitoring and control means by which the actuating means are piloted.

14. A device for the formation of sheets or groups of sheets into ordered stacks, in particular banknotes emerging from respective checking stations of a machine by which banknotes are assembled singly or in bundles and formed into ordered stacks, the machine comprising a plurality of stacking stations equipped with respective feed ducts and stacking channels, the device comprising a companion element associated with each of the stacking stations in such a way as to take up the sheets one on top of another, wherein the companion element is capable of movement between a first receiving position in which the sheets are allowed to accumulate into a stack, and a second release position in which the stack is deposited on respective support means operating in conjunction with the companion element, wherein the companion element is associated with respective actuating means and caused by the selfsame actuating means to alternate cyclically between the first receiving position and the second release position following a predetermined path that consists in a closed loop, wherein the actuating means operate in conjunction with guide means of which the function is to control the translational movement of the companion element between the receiving and release positions, and wherein the guide means are associated with rotary actuating means by which the companion element, having released the stack onto the support means, is rotated and caused as a result to pass freely through the support means and exit from the lower part of the channel, then caused ultimately to re-enter the channel on reaching an upper part remote from the lower part and positioned in readiness to receive further sheets.

15. A device as in claim 14, wherein the companion element is embodied with fingers separated one from another by gaps and affording a first bearing surface on which to position the sheets.

16. A device as in claim 14, wherein the support means comprise a plurality of projections distanced one from another by gaps, of which the free ends afford a second bearing surface offered to the sheets.

17. A device as in claim 16, wherein the fingers of the companion element are insertable into the gaps existing between the projections of the support means.

18. A device as in claim 16, wherein the stacks are removed from the channels by collection and transfer means comprising gripper means.

19. A device as in claim 18, wherein the gripper means are capable of movement horizontally in a direction substantially parallel to the support means and in a direction substantially perpendicular to the support means.

20. A device as in claim 19, wherein the gripper means comprise a top gripping element, and a bottom gripping element embodied with fingers insertable into the gaps existing between the projections of the support means.

21. A device as in claim 20, wherein the distance separating the top gripping element from the bottom gripping element of the gripper means is adjustable.

22. A device as in claim 14, wherein the companion element is capable of movement cyclically from a first receiving position coinciding substantially with the upper part of the stacking channel, in which the sheets are taken up, to the second release position in which the stack is brought to rest on the support means, then back to the first receiving position, following a predetermined path that consists in a closed loop.

23. A device as in claim 14, wherein the actuating means comprise a flexible drive component associated in a closed loop with respective wheels of which one is a driving wheel.

24. A device as in claim 23, wherein the wheels comprise a first wheel positioned to coincide with the upper part of the channel and a second wheel positioned to coincide with the lower part of the channel.

25. A device as in claim 14, wherein the actuating means operate in conjunction with sensors of which the function is to detect the presence of the companion element at the receiving position and at the release position and thereupon supply corresponding signals to monitoring and control means by which the actuating means are piloted.

* * * * *